US012662634B2

(12) United States Patent
Im et al.

(10) Patent No.: US 12,662,634 B2
(45) Date of Patent: Jun. 23, 2026

(54) POLISHING PAD, PYROLYSIS OIL OBTAINED THEREFROM, AND PROCESS FOR PREPARING THE SAME

(71) Applicant: ENPULSE CO., LTD., Cheonan-si (KR)

(72) Inventors: Chang Gyu Im, Gyeonggi-do (KR); Jangwon Seo, Gyeonggi-do (KR)

(73) Assignee: ENPULSE CO., LTD., Chungcheongnam-do (KR)

( * ) Notice: Subject to any disclaimer, the term of this patent is extended or adjusted under 35 U.S.C. 154(b) by 145 days.

(21) Appl. No.: 18/413,034

(22) Filed: Jan. 16, 2024

(65) Prior Publication Data

US 2024/0263080 A1 Aug. 8, 2024

(30) Foreign Application Priority Data

Feb. 6, 2023 (KR) ..... 10-2023-0015431

(51) Int. Cl.
*C10G 1/06* (2006.01)
*B24B 37/24* (2012.01)

(52) U.S. Cl.
CPC ..... *C10G 1/06* (2013.01); *B24B 37/24* (2013.01); *C10G 2300/1003* (2013.01); *C10G 2300/202* (2013.01); *C10G 2300/4006* (2013.01)

(58) Field of Classification Search
CPC ..... B24B 37/22; B24B 37/24; C08G 18/10; C08G 18/3243; C08G 2110/00; C08J 2203/06; C08J 2203/22; C08J 2375/04; C08J 9/32; C10G 1/06; C10G 2300/1003; C10G 2300/202; C10G 2300/4006
See application file for complete search history.

(56) References Cited

U.S. PATENT DOCUMENTS

| | | | |
|---|---|---|---|
| 2005/0064709 | A1 | 3/2005 | Shimomura et al. |
| 2017/0361421 | A1 | 12/2017 | Willumstad et al. |
| 2022/0220389 | A1 | 7/2022 | Slivensky et al. |
| 2022/0396735 | A1 | 12/2022 | Wu et al. |

FOREIGN PATENT DOCUMENTS

| | | | |
|---|---|---|---|
| CN | 1586002 | A | 2/2005 |
| CN | 107520742 | A | 12/2017 |
| EP | 4098400 | A1 | 12/2022 |
| JP | S50-41994 | A | 4/1975 |
| JP | H11-172258 | A | 6/1999 |
| JP | 2019-177456 | A | 10/2019 |

(Continued)

OTHER PUBLICATIONS

KR102206485B1 Translation (Year: 2021).*

(Continued)

*Primary Examiner* — Ellen M McAvoy
*Assistant Examiner* — Chantel Graham
(74) *Attorney, Agent, or Firm* — IP & T GROUP LLP

(57) ABSTRACT

The embodiment relates to a polishing pad that comprises a polishing layer. When pyrolysis oil obtained from the polishing pad is analyzed according to the KS M 2457 standard, the content of chlorine components is 13,000 mg/kg or more. The pyrolysis oil can be used as a high-quality heat source through a refining process. Accordingly, the embodiment can contribute to improving environmental problems while increasing the recycling rate of polishing pads.

11 Claims, 1 Drawing Sheet

(56) References Cited

FOREIGN PATENT DOCUMENTS

| | | | | |
|---|---|---|---|---|
| JP | 2020-040129 | A | 3/2020 | |
| KR | 10-2009-0029336 | A | 3/2009 | |
| KR | 102206485 | B1 * | 1/2021 | ..... H01L 21/67092 |
| KR | 10-2021-0061721 | A | 5/2021 | |
| WO | 2021/201088 | A1 | 10/2021 | |

OTHER PUBLICATIONS

Qian Zhou et al., Catalytic degradation and dechlorination of PVC-containing mixed plastics via Al-Mg composite oxide catalysts, Fuel, Mar. 19, 2004, pp. 1727-1732, vol. 83, Issue 13, Elsevier.

Extended European Search Report for European Patent Application No. 24156000.2 issued by the European Patent Office on Jul. 5, 2024.

Office Action for Japanese Patent Application No. 2024-007050 issued by the Japanese Patent Office on May 13, 2025.

Office Action for the Japanese Patent Application No. 2024-007050 issued by the Japanese Patent Office on Dec. 10, 2024.

Office Action for Chinese Patent Application No. 202410107224.6 issued by the Chinese Patent Office on Jan. 22, 2026.

* cited by examiner

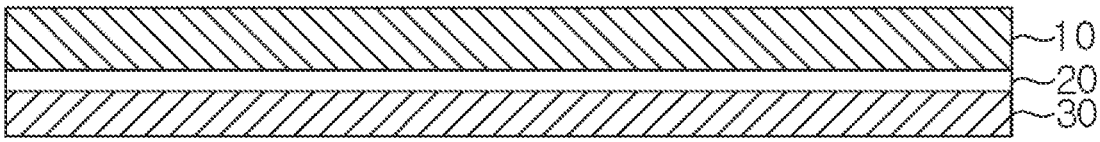
10
20
30

POLISHING PAD, PYROLYSIS OIL OBTAINED THEREFROM, AND PROCESS FOR PREPARING THE SAME

CROSS-REFERENCE TO RELATED APPLICATION(S)

This application claims priority under 35 U.S.C. § 119 to Korean Patent Application No. 10-2023-0015431, filed on Feb. 6, 2023 in the Korean Intellectual Property Office, the disclosure of which is incorporated herein by reference in its entirety.

TECHNICAL FIELD

Embodiments relate to a polishing pad for use in a chemical mechanical planarization (CMP) process of semiconductor devices, to pyrolysis oil obtained from the polishing pad, and to a process for preparing the pyrolysis oil.

BACKGROUND ART

The chemical mechanical planarization (CMP) process in a process for preparing semiconductors refers to a step in which a semiconductor substrate such as a wafer is fixed to a head and in contact with the surface of a polishing pad mounted on a platen, and the platen and the head are relatively moved to planarize the irregularities on the surface of the semiconductor substrate.

In this CMP process, the polishing pad is required to have stable physical properties because it greatly affects the surface processing quality of the semiconductor substrate. In particular, since the polishing rate of the CMP process may vary sensitively depending on the components contained in the polishing pad and their physical properties, it is necessary to optimize the components contained in the polishing pad and their physical properties.

Meanwhile, as the severity of environmental problems has recently emerged, attempts have been made to recycle used polishing pads. However, since it is difficult to process polishing pads for recycling (for example, melt processing using heat), recycling them does not show a satisfactory level of recycling rate.

Accordingly, there is a need to develop a polishing pad that has excellent physical properties and can increase the polishing rate of a CMP process, as well as a technology that can increase the recycling rate of used polishing pads.

PRIOR ART DOCUMENT (Patent Document 1) Korean Laid-open Patent Publication No. 2009-0029336

DETAILED DESCRIPTION OF INVENTION

Technical Problem

In general, a polishing pad comprises a cured polyurethane product formed from a composition comprising a urethane-based prepolymer, a curing agent, and a foaming agent. The present inventors have discovered that the physical properties of a polishing pad vary depending on the content of residual chlorine components upon the pyrolysis of the polishing pad comprising the cured polyurethane product and that a change in the physical properties affects the polishing rate of a CMP process.

In addition, the present inventors have discovered that the recycling rate of a polishing pad can be increased by pyrolyzing the polishing pad.

Accordingly, the embodiments aim to provide a polishing pad that can have excellent physical properties by controlling the content of residual chlorine components upon pyrolysis.

In addition, the embodiments aim to provide pyrolysis oil obtained by pyrolyzing the polishing pad and a process for preparing the same.

Solution to Problem

According to an embodiment for solving the above problem, there is provided a polishing pad that comprises a polishing layer, wherein, when pyrolysis oil obtained by pyrolyzing the polishing pad at 320° C. for 6 hours is analyzed according to the KS M 2457 standard, the content of chlorine components is 13,000 mg/kg or more.

According to another embodiment, there is provided pyrolysis oil that is obtained from a polishing pad, wherein, when the pyrolysis oil is analyzed according to the KS M 2457 standard, the content of chlorine components is 13,000 mg/kg or more.

According to another embodiment, there is provided a process for preparing pyrolysis oil that comprises charging a polishing pad into a chamber; pyrolyzing the polishing pad charged into the chamber at 280 to 350° C.; and passing the vaporized stream formed by the pyrolysis through a heat exchanger to obtain liquid pyrolysis oil, wherein, when the pyrolysis oil is analyzed according to the KS M 2457 standard, the content of chlorine components is 13,000 mg/kg or more.

Advantageous Effects of Invention

The polishing pad according to an embodiment is obtained through an optimized curing reaction by carefully controlling the components such as a urethane-based prepolymer, a curing agent, and a foaming agent, which are raw materials used to prepare a polishing pad, and the contents of the respective components. Thus, the content of residual chlorine components is analyzed within a certain range upon pyrolysis thereof. As a result, mechanical properties such as hardness and elastic modulus can be excellent. Accordingly, when a CMP process is carried out using the polishing pad according to an embodiment, a semiconductor substrate (e.g., wafer) with excellent surface processing quality can be provided while a high polishing rate is achieved.

In addition, the pyrolysis oil according to an embodiment is obtained by pyrolyzing a polishing pad (specifically, a used polishing pad) and can be used as a high-quality heat source (e.g., heating oil, power plant fuel, or the like) through a refining process. Accordingly, the embodiments can contribute to improving environmental problems while increasing the recycling rate of polishing pads.

BRIEF DESCRIPTION OF DRAWINGS

FIG. 1 is a cross-sectional view showing a polishing pad according to an embodiment (10: polishing layer, 20: adhesive layer, 30: cushion layer).

BEST MODE FOR CARRYING OUT THE INVENTION

Hereinafter, the present invention will be described with reference to embodiments. Here, the embodiments are not limited to what has been disclosed below. The embodiments may be modified into various forms as long as the gist of the invention is not altered.

In the present specification, in the case where an element is mentioned to be formed, connected, or combined on or under another element, it means all of the cases where one element is directly, or indirectly through another element, formed, connected, or combined with another element. In addition, it should be understood that the criterion for the terms on and under of each component may vary depending on the direction in which the object is observed.

In the present specification, the term "comprising" is intended to specify a particular characteristic, region, step, process, element, and/or component. It does not exclude the presence or addition of any other characteristic, region, step, process, element and/or component, unless specifically stated to the contrary.

All numbers and expressions related to the quantities of components, reaction conditions, and the like used herein are to be understood as being modified by the term "about," unless otherwise indicated.

Polishing Pad

An embodiment provides a polishing pad, which comprises a polishing layer and, if necessary, further comprises an adhesive layer and a cushion layer. The polishing pad according to an embodiment has the characteristic that the content of residual chlorine components upon pyrolysis is controlled, which will be described in detail with reference to FIG. 1, as follows.

Polishing Layer

The polishing layer (10) adopted in the polishing pad according to an embodiment serves to polish a semiconductor substrate (e.g., wafer) that is subjected to polishing. The polishing layer (10) may be formed (prepared) using a composition (a composition for forming a polishing layer) comprising a urethane-based prepolymer, a curing agent, and a foaming agent.

The urethane-based prepolymer contained in the composition may be a polymer prepared by reacting a polyol compound and an isocyanate compound. The urethane-based prepolymer may have a weight average molecular weight (Mw) of 500 to 3,000 g/mole, specifically, 600 to 2,000 g/mole, 700 to 1,500 g/mole, or 800 to 1,000 g/mole.

In addition, the urethane-based prepolymer may have an isocyanate end group content (NCO %) of 7.5 to 11% by weight, specifically, 7.5 to 10% by weight, 8 to 10% by weight, or 8.5 to 9.5% by weight. As the NCO % is within the above range, it is possible to provide a polishing pad capable of minimizing the occurrence of defects in a semiconductor substrate in a CMP process while exerting the required level of polishing speed, polishing profile, and the like. Such a polishing pad may have a relatively high content of residual chlorine components upon pyrolysis.

The polyol compound for preparing the urethane-based prepolymer may be at least one selected from the group consisting of a polyether polyol, a polyester polyol, a polycarbonate polyol, and an acryl polyol. More specifically, the polyol compound may comprise at least one selected from the group consisting of polytetramethylene ether glycol, polypropylene ether glycol, ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, and tripropylene glycol.

The polyol compound may have a weight average molecular weight (Mw) of 100 to 3,000 g/mole, specifically, 100 to 2,500 g/mole, 200 to 2,000 g/mole, or 300 to 1,800 g/mole. For example, the polyol compound may comprise a low molecular weight polyol compound having a weight average molecular weight (Mw) of 100 to less than 300 g/mole and a high molecular weight polyol compound having a weight average molecular weight (Mw) of 300 to 1,800 g/mole.

The isocyanate compound for preparing the urethane-based prepolymer may specifically be at least one selected from the group consisting of an aromatic diisocyanate, an aliphatic diisocyanate, and an alicyclic diisocyanate. More specifically, the isocyanate compound may comprise at least one selected from the group consisting of 2,4-toluene diisocyanate, 2,6-toluene diisocyanate, naphthalene-1,5-diisocyanate, p-phenylene diisocyanate, tolidine diisocyanate, 4,4'-diphenylmethane diisocyanate, hexamethylene diisocyanate, dicyclohexylmethane diisocyanate, and isophorone diisocyanate.

The curing agent may comprise a compound that undergoes a curing reaction with the urethane-based prepolymer. Specifically, the curing agent may comprise at least one selected from the group consisting of an aromatic amine, an aliphatic amine, an aromatic alcohol, and an aliphatic alcohol. More specifically, the curing agent may comprise at least one selected from the group consisting of 4,4'-methylenebis(2-chloroaniline), diethyltoluenediamine, diaminodiphenylmethane, dimethylthio-toluene diamine, propanediol bis-p-aminobenzoate, diaminodiphenyl sulphone, m-xylylenediamine, isophoronediamine, ethylenediamine, diethylenetriamine, triethylenetetramine, polypropylenediamine, and polypropylenetriaminee.

For example, the curing agent preferably comprises 4,4'-methylenebis(2-chloroaniline). As the curing agent comprises 4,4'-methylenebis(2-chloroaniline), the curing reaction is optimized, whereby it is possible to provide a polishing pad in which the overall physical properties are excellent and the content of residual chlorine components upon pyrolysis is controlled to be relatively high.

The content of the curing agent may be 18 to 27 parts by weight, specifically 19 to 26 parts by weight or 20 to 26 parts by weight, relative to 100 parts by weight of the urethane-based prepolymer. As the content of the curing agent is within the above range, it may be more advantageous for achieving a polishing pad with excellent physical properties.

Meanwhile, the reaction ratio (curing reaction ratio) of the urethane-based prepolymer and the curing agent may be specifically 1:0.75 to 1.1 as an equivalence ratio, 1:0.8 to 1.05 as an equivalence ratio, 1:0.85 to 1.05 as an equivalence ratio, or 1:0.9 to 1 as an equivalence ratio. As the curing reaction is carried out at the above reaction ratio, the curing reaction is optimized, whereby it is possible to provide a polishing pad in which the overall physical properties are excellent and the content of residual chlorine components upon pyrolysis is controlled to be relatively high.

The foaming agent contained in the composition is for forming a pore structure in the polishing layer (10). It may comprise at least one selected from the group consisting of a solid phase foaming agent, a liquid phase foaming agent, and a gas phase foaming agent (e.g., inert gases such as nitrogen, argon, helium, and the like). Specifically, the foaming agent may preferably be a solid phase foaming agent comprising expandable particles.

The expandable particles are particles having a characteristic that can be expanded by heat or pressure. Specifically, the expandable particles may comprise thermally expanded particles, unexpanded particles, or a combination thereof. The thermally expanded particles are particles expanded in advance by heat. The unexpanded particles may refer to particles whose final size is determined when expanded by heat or pressure applied during the process of preparing the polishing layer (10). The expandable particles may comprise a shell of a resin; and an expansion-inducing component encapsulated inside the shell.

The shell of a resin may comprise a thermoplastic resin. Specifically, the thermoplastic resin may be at least one selected from the group consisting of a vinylidene chloride-based copolymer, an acrylonitrile-based copolymer, a methacrylonitrile-based copolymer, and an acrylic-based copolymer.

The expansion-inducing component may comprise at least one selected from the group consisting of a hydrocarbon compound, a chlorofluoro compound, and a tetraalkylsilane compound.

Specifically, the hydrocarbon compound may comprise at least one selected from the group consisting of ethane, ethylene, propane, propene, n-butane, isobutane, n-butene, isobutene, n-pentane, isopentane, neopentane, n-hexane, heptane, and petroleum ether.

The chlorofluoro compound may comprise at least one selected from the group consisting of trichlorofluoromethane ($CCl_3F$), dichlorodifluoromethane ($CCl_2F_2$), chlorotrifluoromethane ($CClF_3$), and dichlorotetrafluoroethylene ($CClF_2$—$CClF_2$).

The tetraalkylsilane compound may comprise at least one selected from the group consisting of tetramethylsilane, trimethylethylsilane, trimethylisopropylsilane, and trimethyl-n-propylsilane.

For example, the expansion-inducing component may be the chlorofluoro compound. As the expansion-inducing component is the chlorofluoro compound, the pore structure within the polishing layer (10) is formed uniformly and at the required level, whereby it is possible to provide a polishing pad in which the overall physical properties are excellent and the content of residual chlorine components upon pyrolysis is controlled to be relatively high.

This solid phase foaming agent may have an average particle diameter of 5 to 200 μm, specifically, 10 to 100 μm, 15 to 70 μm, or 20 to 45 μm. Here, when the solid phase foaming agent comprises the thermally expanded particles as the expandable particles, the average particle diameter may refer to the average particle diameter of the thermally expanded particles themselves. Here, when the solid phase foaming agent comprises the unexpanded particles as the expandable particles, the average particle diameter may refer to the average particle diameter of the particles upon expansion by heat or pressure.

The content of the solid phase foaming agent may be 0.5 to 10 parts by weight, specifically, 0.7 to 5 parts by weight, 0.9 to 3 parts by weight, or 1 to 2 parts by weight, relative to 100 parts by weight of the urethane-based prepolymer. As the content of the solid phase foaming agent is within the above range, it may be more advantageous for achieving a polishing pad with excellent physical properties.

Meanwhile, the composition for preparing a polishing layer (10) may further comprise other additives such as a surfactant and a reaction rate controlling agent.

The surfactant may specifically be a silicone-based surfactant.

The reaction rate controlling agent may specifically comprise at least one selected from the group consisting of triethylenediamine, dimethylethanolamine, tetramethylbutanediamine, 2-methyl-triethylenediamine, dimethylcyclohexylamine, triethylamine, triisopropanolamine, 1,4-diazabicyclo(2,2,2)octane, bis(2-methylaminoethyl) ether, trimethylaminoethylethanolamine, N,N,N,N,N"-pentamethyldiethyldimethylaminoethylamine, dimethylaminopropylamine, benzyldimethylamine, N-ethylmorpholine, N,N-dimethylaminoethylmorpholine, N,N-dimethylcyclohexylamine, 2-methyl-2-azanobornene, dibutyltin dilaurate, stannous octoate, dibutyltin diacetate, dioctyltin diacetate, dibutyltin maleate, dibutyltin bis(2-ethylhexanoate), and dibutyltin dimercaptide.

The thickness of the polishing layer (10) formed from the composition is not particularly limited. Specifically, it may be 0.5 to 5 mm, 1 to 4.5 mm, 1.5 to 4 mm, or 2 to 3 mm. As the thickness of the polishing layer (10) is within the above range, the CMP process can be carried out stably, and the polishing pad can be made lighter.

Cushion Layer

The cushion layer further adopted in the polishing pad according to an embodiment is provided under the polishing layer (10) and serves to stably support the polishing layer (10) and to absorb and/or disperse an impact applied to the polishing layer (10). The cushion layer (30) may be formed (prepared) using a nonwoven fabric or a porous pad.

The thickness of the cushion layer (30) is not particularly limited, but it may specifically be 0.5 to 2.5 mm, 0.6 to 2.3 mm, 0.7 to 2 mm, or 1 to 1.5 mm. As the thickness of the cushion layer (30) is within the above range, it can stably support the polishing layer (10), and the polishing pad (100) can be made lighter.

Adhesive Layer

The adhesive layer (20) further adopted in the polishing pad according to an embodiment is provided between the polishing layer (10) and the cushion layer (30) and serves to bond the polishing layer (10) and the cushion layer (30). Further, the adhesive layer (20) may also serve to prevent a polishing slurry supplied to the polishing layer (10) from leaking into the cushion layer (30). The adhesive layer (20) may be formed (prepared) using a hot melt adhesive composition.

The hot melt adhesive composition may comprise a commonly known hot melt adhesive. The hot melt adhesive may specifically comprise at least one selected from the group consisting of a polyurethane resin, a polyester resin, an ethylene-vinyl acetate resin, a polyamide resin, and a polyolefin resin.

The thickness of the adhesive layer (20) is not particularly limited, but it may specifically be 5 to 30 μm, 10 to 30 μm, 20 to 27 μm, or 23 to 25 μm. As the thickness of the adhesive layer (20) is within the above range, the required level of bonding strength (adhesive strength) between the polishing layer (10) and the cushion layer (30) can be secured.

Meanwhile, the polishing pad according to an embodiment may comprise residual chlorine components upon pyrolysis. That is, the polishing pad according to an embodiment is controlled such that the content of chlorine components upon pyrolysis is within a specific range. As a result, it can have excellent physical properties such as hardness and elastic modulus and can have a high polishing rate and polishing flatness in a CMP process.

Specifically, in the polishing pad according to an embodiment, when pyrolysis oil obtained by pyrolyzing the polishing pad at 320° C. for 6 hours is analyzed according to the KS M 2457 standard, the content of chlorine components is 13,000 mg/kg (=ppm) or more. More specifically, the content of chlorine components may be 13,300 mg/kg or more, 13,500 mg/kg or more, 13,800 mg/kg or more, or 14,000 mg/kg or more. For example, the content of chlorine components may be 13,000 to 16,000 mg/kg, 13,300 to 15,800 mg/kg, 13,500 to 15,700 mg/kg, 13,800 to 15,500 mg/kg, or 14,000 to 15,300 mg/kg. As the content of residual chlorine components contained in the pyrolysis oil obtained by pyrolyzing the polishing pad is within the above range, the polishing pad can have high hardness and elastic modulus without causing environmental problems due to the chlorine components.

In addition, the polishing pad according to an embodiment may comprise residual metal components upon pyrolysis. Specifically, in the polishing pad according to an embodiment, when pyrolysis oil obtained by pyrolyzing the polishing pad at 320° C. for 6 hours is analyzed by inductively coupled plasma atomic emission spectrometry, the content of metal components is less than 4 mg/kg (=ppm). More specifically, the content of metal components may be 1 μg/kg (=ppb) to 2 mg/kg, 10 μg/kg to 1 mg/kg, 100 μg/kg to 800 μg/kg, or 300 μg/kg to 500 μg/kg. The metal components are derived from the catalyst components used in preparing the polishing pad, and the detection of the metal components may mean that a polishing pad with excellent physical properties has been prepared. Specifically, as the content of metal components contained in the pyrolysis oil obtained by pyrolyzing the polishing pad is within the above range, the polishing pad can have high strength and hardness. Meanwhile, the metal components are not particularly limited, but they may specifically comprise at least one selected from the group consisting of cadmium (Cd), chromium (Cr), lead (Pb), and arsenic (As).

Meanwhile, the pyrolysis oil obtained by pyrolyzing the polishing pad according to an embodiment may contain various substances. When it is distilled, it may exhibit a boiling point in a specific range depending on the respective substances contained in the pyrolysis oil. Specifically, when the boiling point of the pyrolysis oil (substances contained in the pyrolysis oil) is analyzed according to ASTM D2887 (specifically, ASTM D2887-19a), the initial boiling point may be 53 to 62° C., and the final boiling point may be 510 to 520° C. For example, the initial boiling point of the pyrolysis oil may be 54 to 61° C., 55 to 60° C., 56 to 59° C., or 57 to 58° C. In addition, the final boiling point of the pyrolysis oil may be 511 to 519° C., 512 to 518° C., 513 to 517° C., or 514 to 516° C.

In addition, when the boiling point is analyzed by distillation of the pyrolysis oil, the boiling point of the substances accounting for 5% by weight of the pyrolysis oil may be 62 to 73° C. (e.g., 63 to 72° C. or 65 to 70° C.), the boiling point of the substances accounting for 10% by weight of the pyrolysis oil may be 73 to 90° C. (e.g., 74 to 85° C. or 75 to 80° C.), the boiling point of the substances accounting for 20% by weight of the pyrolysis oil may be 90 to 110° C. (e.g., 92 to 105° C. or 95 to 100° C.), the boiling point of the substances accounting for 30% by weight of the pyrolysis oil may be 110 to 130° C. (e.g., 112 to 125° C. or 115 to 120° C.), the boiling point of the substances accounting for 40% by weight of the pyrolysis oil may be 130 to 185° C. (e.g., 135 to 175° C. or 145 to 155° C.), and the boiling point of the substances accounting for 50% by weight of the pyrolysis oil may be 185 to 225° C. (e.g., 190 to 210° C. or 192 to 200° C.). In addition, the boiling point of the substances accounting for 60% by weight of the pyrolysis oil may be 225 to 265° C. (e.g., 228 to 245° C. or 230 to 235° C.), the boiling point of the substances accounting for 70% by weight of the pyrolysis oil may be 265 to 325° C. (e.g., 270 to 310° C. or 275 to 285° C.), the boiling point of the substances accounting for 80% by weight of the pyrolysis oil may be 325 to 350° C. (e.g., 328 to 340° C. or 330 to 335° C.), the boiling point of the substances accounting for 90% by weight of the pyrolysis oil may be 350 to 420° C. (e.g., 370 to 400° C. or 385 to 395° C.), and the boiling point of the substances accounting for 95% by weight of the pyrolysis oil may be 420 to 505° C. (e.g., 425 to 480° C. or 430 to 440° C.).

The polishing pad according to an embodiment may have a Shore D hardness of greater than 50, 52 or more, 54 or more, or 56 or more (specifically, greater than 50 to 65, 52 to 63, 54 to 62, or 55 to 60).

In addition, the polishing pad according to an embodiment may have an elastic modulus of 90 $N/mm^2$ or more, 95 $N/mm^2$ or more, 100 $N/mm^2$ or more, 110 $N/mm^2$ or more, 120 $N/mm^2$ or more, or 130 $N/mm^2$ or more (specifically, 90 to 160 $N/mm^2$, 95 to 158 $N/mm^2$, 100 to 155 $N/mm^2$, 110 to 153 $N/mm^2$, or 120 to 150 $N/mm^2$).

The polishing pad according to an embodiment can exhibit excellent polishing rate and polishing flatness in a CMP process.

Specifically, the polishing pad according to an embodiment may have a polishing rate (Å/minute) of 3,700 Å/minute or more, 3,800 Å/minute or more, 3,900 Å/minute or more, 3,950 Å/minute or more, or 4,000 Å/minute or more (specifically, 3,700 to 4,500 Å/minute, 3,800 to 4,400 Å/minute, 3,900 to 4,350 Å/minute, or 4,000 to 4,300 Å/minute).

In addition, the polishing pad according to an embodiment may have a within-wafer non-uniformity (%) of 4.9% or more, 5.0% or more, 5.1% or more, 5.2% or more, or 5.3% or more (specifically, 4.9 to 6.5%, 5.0 to 6.3%, 5.1 to 6.2%, 5.2 to 6.1%, or 5.3 to 6.0%).

Meanwhile, the polishing pad according to an embodiment may have a pyrolysis temperature of 280 to 345° C., 290 to 340° C., 295 to 330° C., 300 to 325° C., or 310 to 320° C.

The polishing pad according to an embodiment may be prepared by a process comprising sequentially or simultaneously mixing a urethane-based prepolymer, a curing agent, and a foaming agent to prepare a composition; and injecting the composition into a mold and curing it to form a polishing layer.

The mixing may specifically be carried out at a speed of 1,000 to 10,000 rpm or 4,000 to 7,000 rpm. When the composition is prepared through the mixing, the temperature may be 50° C. to 150° C. If necessary, it may be carried out under vacuum defoaming conditions.

The step of forming a polishing layer may be carried out under the temperature condition of 60 to 150° C. and the pressure condition of 50 to 260 $kg/m^2$.

The polishing pad according to an embodiment may be prepared by a further step of forming an adhesive layer and a cushion layer after forming the polishing layer. In addition, a step of cutting the surface of the polishing layer, a step of machining a groove on the surface of the polishing layer, an inspection step, a packaging step, or the like may be further performed. A typical method of preparing a polishing pad may be adopted in these steps.

Pyrolysis Oil

An embodiment provides pyrolysis oil obtained from a polishing pad. Specifically, the pyrolysis oil according to an embodiment is pyrolysis oil obtained from a polishing pad. When it is analyzed according to the KS M 2457 standard, the content of chlorine components may be 13,000 mg/kg (=ppm) or more. Specifically, the content of chlorine components may be 13,300 mg/kg or more, 13,500 mg/kg or more, 13,800 mg/kg or more, or 14,000 mg/kg or more. For example, the content of chlorine components may be 13,000 to 16,000 mg/kg, 13,300 to 15,800 mg/kg, 13,500 to 15,700 mg/kg, 13,800 to 15,500 mg/kg, or 14,000 to 15,300 mg/kg.

As the content of residual chlorine components contained in the pyrolysis oil is within the above range, the pyrolysis oil can be converted into a high-quality heat source.

Specifically, the pyrolysis oil obtained by pyrolyzing the polishing pad can be converted into heavy oil, naphtha, or the like through a refining process (e.g., distillation). In such an event, the heavy oil may be used as a heat source such as heating oil and power plant fuel. In addition, the naphtha can be converted into basic petrochemical raw materials such as benzene, toluene, xylene, butanediol, or the like through a cracking process and used in industry.

In addition, the pyrolysis oil obtained by pyrolyzing the polishing pad may comprise metal components. Specifically, when the pyrolysis oil according to an embodiment is analyzed by inductively coupled plasma atomic emission spectrometry, the content of metal components is less than 4 mg/kg (=ppm). More specifically, the content of metal components may be 1 μg/kg (=ppb) to 2 mg/kg, 10 μg/kg to 1 mg/kg, 100 μg/kg to 800 μg/kg, or 300 μg/kg to 500 μg/kg. The metal components are not particularly limited, but they may specifically comprise at least one selected from the group consisting of cadmium (Cd), chromium (Cr), lead (Pb), and arsenic (As).

In addition, the pyrolysis oil according to an embodiment may contain various substances. When it is distilled, it may exhibit a boiling point in a specific range depending on the respective substances contained in the pyrolysis oil. Specifically, when the boiling point of the pyrolysis oil (substances contained in the pyrolysis oil) is analyzed according to ASTM D2887 (specifically, ASTM D2887-19a), the initial boiling point may be 53 to 62° C., and the final boiling point may be 510 to 520° C. For example, the initial boiling point of the pyrolysis oil may be 54 to 61° C., 55 to 60° C., 56 to 59° C., or 57 to 58° C. In addition, the final boiling point of the pyrolysis oil may be 511 to 519° C., 512 to 518° C., 513 to 517° C., or 514 to 516° C.

In addition, when the boiling point is analyzed by distillation of the pyrolysis oil, the boiling point of the substances accounting for 5% by weight of the pyrolysis oil may be 62 to 73° C. (e.g., 63 to 72° C. or 65 to 70° C.), the boiling point of the substances accounting for 10% by weight of the pyrolysis oil may be 73 to 90° C. (e.g., 74 to 85° C. or 75 to 80° C.), the boiling point of the substances accounting for 20% by weight of the pyrolysis oil may be 90 to 110° C. (e.g., 92 to 105° C. or 95 to 100° C.), the boiling point of the substances accounting for 30% by weight of the pyrolysis oil may be 110 to 130° C. (e.g., 112 to 125° C. or 115 to 120° C.), the boiling point of the substances accounting for 40% by weight of the pyrolysis oil may be 130 to 185° C. (e.g., 135 to 175° C. or 145 to 155° C.), and the boiling point of the substances accounting for 50% by weight of the pyrolysis oil may be 185 to 225° C. (e.g., 190 to 210° C. or 192 to 200° C.). In addition, the boiling point of the substances accounting for 60% by weight of the pyrolysis oil may be 225 to 265° C. (e.g., 228 to 245° C. or 230 to 235° C.), the boiling point of the substances accounting for 70% by weight of the pyrolysis oil may be 265 to 325° C. (e.g., 270 to 310° C. or 275 to 285° C.), the boiling point of the substances accounting for 80% by weight of the pyrolysis oil may be 325 to 350° C. (e.g., 328 to 340° C. or 330 to 335° C.), the boiling point of the substances accounting for 90% by weight of the pyrolysis oil may be 350 to 420° C. (e.g., 370 to 400° C. or 385 to 395° C.), and the boiling point of the substances accounting for 95% by weight of the pyrolysis oil may be 420 to 505° C. (e.g., 425 to 480° C. or 430 to 440° C.).

The temperature at which the polishing pad is pyrolyzed to obtain the pyrolysis oil is not particularly limited. It may specifically be 280 to 350° C., more specifically, 280 to 345° C., 290 to 340° C., 295 to 330° C., 300 to 325° C., or 310 to 320° C.

Meanwhile, when the pyrolysis of the polishing pad is completed, residual solids remain, which may be used as solid fuel.

The pyrolysis oil is obtained from the polishing pad described above. In such a case, the polishing pad may be a spent polishing pad that has been used in a CMP process. Accordingly, the embodiment can improve the conventional problem of difficulty in recycling waste polishing pads. Further, it may contribute to providing renewable energy and reducing environmental problems.

Process for Preparing Pyrolysis Oil

An embodiment provides a process for the preparing pyrolysis oil described above. Specifically, the process for preparing pyrolysis oil comprises charging a polishing pad into a chamber (step S-1); pyrolyzing the polishing pad charged into the chamber at 280 to 350° C. (step S-2); and passing the vaporized stream formed by the pyrolysis through a heat exchanger to obtain liquid pyrolysis oil (step S-3).

Step S-1 may be carried out by charging a polishing pad, specifically, a spent polishing pad, into a chamber. That is, a spent polishing pad that has been used in a CMP process may be charged into the chamber. Here, when the spent polishing pad further comprises a cushion layer and an adhesive layer in addition to a polishing layer, the spent polishing pad may be charged into the chamber in its discarded state (in which the polishing layer, adhesive layer, and cushion layer are combined) without the process of separating the respective layers. In addition, one or more spent polishing pads, specifically, 1 to 5 or 2 to 3 spent polishing pads, may be charged into the chamber at the same time. Accordingly, the embodiment can easily recycle (treat) the spent polishing pads.

The chamber is mounted on a reactor capable of performing the pyrolysis of the polishing pad, and it may be made of a heat-resistant material. It may have a structure that is detached from the reactor when the pyrolysis is completed. Waste materials (scraps) generated during the preparation of the polishing pad, in addition to the polishing pad (specifically, spent polishing pad), may be further charged into the chamber.

Step S-2 may be carried out by pyrolyzing the polishing pad charged into the chamber at 280 to 350° C. Specifically, the pyrolysis temperature of the polishing pad may be 280 to 345° C., 290 to 340° C., 295 to 330° C., 300 to 325° C., or 310 to 320° C. As the polishing pad is pyrolyzed in the above temperature range, pyrolysis oil can be obtained in high yield, and the generation of harmful substances such as dioxin during the pyrolysis process can be minimized. In addition, the pyrolysis oil can be controlled to contain chlorine components at the required level.

Meanwhile, the pyrolysis of the polishing pad may be carried out in the presence of a catalyst. The catalyst is not particularly limited as long as it is a commonly known catalyst used in the pyrolysis process of polymers. Specifically, it may comprise zeolite or potassium hydroxide. As the pyrolysis is carried out in the presence of the catalyst, the yield of pyrolysis oil can be increased while the production of by-products such as tar can be suppressed.

As step S-2 is carried out, the pyrolysis oil may be vaporized and converted into a vaporized stream.

Step S-3 may be carried out by passing the vaporized stream formed by the pyrolysis through a heat exchanger to obtain liquid pyrolysis oil. Specifically, the vaporized stream may be cooled through the heat exchanger to be converted into liquid pyrolysis oil. The heat exchanger may not be particularly limited as long as it is made of a commonly known structure and material.

The pyrolysis oil obtained through step S-3 may contain chlorine components. Specifically, when the pyrolysis oil is analyzed according to the KS M 2457 standard, the content of chlorine components may be 13,000 mg/kg (=ppm) or more. More specifically, the content of chlorine components may be 13,300 mg/kg or more, 13,500 mg/kg or more, 13,800 mg/kg or more, or 14,000 mg/kg or more. For example, the content of chlorine components may be 13,000 to 16,000 mg/kg, 13,300 to 15,800 mg/kg, 13,500 to 15,700 mg/kg, 13,800 to 15,500 mg/kg, or 14,000 to 15,300 mg/kg.

Meanwhile, the solids remaining in the chamber upon completion of step S-3 may be used as solid fuel through a separate recovery process.

In addition, the pyrolysis oil obtained through step S-3 may be subjected to a refining process such as distillation.

MODE FOR THE INVENTION

Hereinafter, the present embodiments will be described in detail with reference to Examples, but the scope of the present embodiments is not limited to the Examples.

Example 1

A polishing pad was prepared using a casting device equipped with injection lines for a urethane-based prepolymer, a curing agent, an inert gas, and a reaction rate controlling agent.

Specifically, the prepolymer tank was charged with a urethane-based prepolymer (SKC) containing 9.3% by weight of unreacted NCO, the curing agent tank was charged with 4,4'-methylenebis(2-chloroaniline) (Ishihara), and nitrogen (N2) was used as an inert gas. In addition, 1 part by weight of a solid phase foaming agent (AkzoNobel) and 1 part by weight of a silicone-based surfactant (Evonik) were mixed in advance relative to 100 parts by weight of the urethane-based prepolymer and then charged into the prepolymer tank.

The raw materials were stirred while they were fed to the mixing head at constant rates through the respective feeding lines. In such an event, the prepolymer and the curing agent were fed at an equivalent ratio of 1:0.95, and nitrogen (N2), an inert gas, was injected at a rate of 1 liter/minute. The mixed raw materials were injected into a mold (1,000 mm×1,000 mm×3 mm) preheated to 80° C. at a charge rate of 10 kg/minute and cast at 120° C. to obtain a molded article. Thereafter, the top and bottom of the molded article were each ground by a thickness of 0.5 mm to obtain a polishing sheet (polishing layer) having a thickness of 2 mm.

Next, a cushion sheet was prepared in which a polyester fiber nonwoven fabric was impregnated with a polyurethane resin.

Next, the polishing sheet and the cushion sheet were combined using a hot melt adhesive to prepare a polishing pad (thickness: 3.4 mm) having a structure of a polishing layer, an adhesive layer, and a cushion layer.

Example 2

A polishing pad was prepared using a casting device equipped with injection lines for a urethane-based prepolymer, a curing agent, an inert gas, and a reaction rate controlling agent. In such an event, the inert gas injection line was blocked.

Specifically, the prepolymer tank was charged with a urethane-based prepolymer (SKC) containing 9.3% by weight of unreacted NCO, and the curing agent tank was charged with 4,4'-methylenebis(2-chloroaniline) (Ishihara). In addition, 2 parts by weight of a solid phase foaming agent (AkzoNobel) was mixed in advance relative to 100 parts by weight of the urethane-based prepolymer, which was charged to the prepolymer tank.

The raw materials were stirred while they were fed to the mixing head at constant rates through the respective feeding lines. In such an event, the prepolymer and the curing agent were fed at an equivalent ratio of 1:1.05. The mixed raw materials were injected into a mold (1,000 mm×1,000 mm×3 mm) preheated to 80° C. at a charge rate of 10 kg/minute and cast at 80° C. to obtain a molded article. Thereafter, the top and bottom of the molded article were each ground by a thickness of 0.5 mm to obtain a polishing sheet (polishing layer) having a thickness of 2 mm.

Next, a cushion sheet was prepared in which a polyester fiber nonwoven fabric was impregnated with a polyurethane resin.

Next, the polishing sheet and the cushion sheet were combined using a hot melt adhesive to prepare a polishing pad (thickness: 3.4 mm) having a structure of a polishing layer, an adhesive layer, and a cushion layer.

Comparative Example 1

A polishing pad was prepared using a casting device equipped with injection lines for a urethane-based prepolymer, a curing agent, an inert gas, and a reaction rate controlling agent.

Specifically, the prepolymer tank was charged with a urethane-based prepolymer (SKC) containing 9.3% by weight of unreacted NCO, the curing agent tank was charged with 4,4'-methylenebis(2-chloroaniline) (Ishihara), and nitrogen (N2) was used as an inert gas. In addition, 1 part by weight of a solid phase foaming agent (AkzoNobel) and 1 part by weight of a silicone-based surfactant (Evonik) were mixed in advance relative to 100 parts by weight of the urethane-based prepolymer and then charged into the prepolymer tank.

The raw materials were stirred while they were fed to the mixing head at constant rates through the respective feeding lines. In such an event, the prepolymer and the curing agent were fed at an equivalent ratio of 1:0.7, and nitrogen (N2), an inert gas, was injected at a rate of 1 liter/minute. The mixed raw materials were injected into a mold (1,000 mm×1,000 mm×3 mm) preheated to 80° C. at a charge rate of 10 kg/minute and cast at 80° C. to obtain a molded article. Thereafter, the top and bottom of the molded article were each ground by a thickness of 0.5 mm to obtain a polishing sheet (polishing layer) having a thickness of 2 mm.

Next, a cushion sheet was prepared in which a polyester fiber nonwoven fabric was impregnated with a polyurethane resin.

Next, the polishing sheet and the cushion sheet were combined using a hot melt adhesive to prepare a polishing pad (thickness: 3.4 mm) having a structure of a polishing layer, an adhesive layer, and a cushion layer.

Comparative Example 2

A polishing pad was prepared using a casting device equipped with injection lines for a urethane-based prepolymer, a curing agent, an inert gas, and a reaction rate controlling agent.

Specifically, the prepolymer tank was charged with a urethane-based prepolymer (SKC) containing 7.1% by weight of unreacted NCO, the curing agent tank was charged with 4,4'-methylenebis(2-chloroaniline) (Ishihara), and nitrogen (N2) was used as an inert gas. In addition, 1 part by weight of a solid phase foaming agent (AkzoNobel) and 1 part by weight of a silicone-based surfactant (Evonik) were mixed in advance relative to 100 parts by weight of the urethane-based prepolymer and then charged into the prepolymer tank.

The raw materials were stirred while they were fed to the mixing head at constant rates through the respective feeding lines. In such an event, the prepolymer and the curing agent were fed at an equivalent ratio of 1:0.95, and nitrogen (N2), an inert gas, was injected at a rate of 1 liter/minute. The mixed raw materials were injected into a mold (1,000 mm×1,000 mm×3 mm) preheated to 80° C. at a charge rate of 10 kg/minute and cast at 80° C. to obtain a molded article. Thereafter, the top and bottom of the molded article were each ground by a thickness of 0.5 mm to obtain a polishing sheet (polishing layer) having a thickness of 2 mm.

Next, a cushion sheet was prepared in which a polyester fiber nonwoven fabric was impregnated with a polyurethane resin.

Next, the polishing sheet and the cushion sheet were combined using a hot melt adhesive to prepare a polishing pad (thickness: 3.4 mm) having a structure of a polishing layer, an adhesive layer, and a cushion layer.

Comparative Example 3

A polishing pad was prepared through the same procedure as in Example 1, except that dimethylthio-toluene diamine (Covestro) was used as a curing agent instead of 4,4'-methylenebis(2-chloroaniline).

Test Example 1: Analysis of the Content of Chlorine Components 1

Three polishing pads prepared in each of Examples 1 and 2 and Comparative Examples 1 to 3 were placed in a chamber, and the polishing pads were pyrolyzed at a temperature of 320° C. for 6 hours. The vaporized stream formed by the pyrolysis was passed through a heat exchanger to obtain liquid pyrolysis oil. Thereafter, when the liquid pyrolysis oil stream disappeared, the production of pyrolysis oil was completed through a cooling process.

The pyrolysis oil thus prepared was analyzed for the content of chlorine components according to the KS M 2457 standard (KS M 2457:2003). The results are shown in Table 1 below.

Test Example 2: Analysis of the Content of Chlorine Components 2

The polishing pads prepared in Examples 1 and 2 were each fixed to the platen of CMP equipment, and a silicon wafer (diameter: 300 mm) was set with the tungsten (W) film thereof facing downward. Then, a CMP process was carried out (polishing load: 2.8 psi, calcined silica slurry applied). Next, the CMP process was repeated until it was determined that the polishing pad could not be used. Thereafter, the polishing pad (spent polishing pad) determined to be unusable was collected, and pyrolysis oil was prepared through the same procedure as in Test Example 1.

The pyrolysis oil thus prepared was analyzed for the content of chlorine components according to the KS M 2457 standard (KS M 2457:2003). The results are shown in Table 1 below.

TABLE 1

| | Content of chlorine components (mg/kg) |
|---|---|
| Example 1 | 14,126 |
| Example 2 | 15,184 |
| Example 1 (spent polishing pad) | 14,527 |
| Example 2 (spent polishing pad) | 14,819 |
| Comparative Example 1 | 11,256 |
| Comparative Example 2 | 10,861 |
| Comparative Example 3 | 26 |

Referring to Table 1 above, the polishing pads (polishing pads before the polishing process) according to Examples 1 and 2, falling under the embodiment, had a content of chlorine components of 13,000 mg/kg or more upon pyrolysis, while the polishing pad according to Comparative Example 1 to 3 had a content of chlorine components of less than 13,000 mg/kg upon pyrolysis.

Meanwhile, the spent polishing pads according to Examples 1 and 2 collected after the CMP process also had a content of chlorine components of 13,000 mg/kg or more upon pyrolysis, indicating that the chlorine components were not derived from the CMP process but from the polishing pad itself.

Test Example 3: Analysis of the Content of Metal Components

The pyrolysis oil of Example 1 obtained through Test Example 1 was analyzed by high-frequency inductively coupled plasma emission spectrometry (analysis device: OPTIMA 7300 DV, Perkin-Elmer) to confirm metal components.

TABLE 2

| Metal component | Content (mg/kg) |
|---|---|
| Cd | less than 1 |
| Cr | less than 1 |
| Pb | 1 |
| As | less than 1 |

Referring to Table 2 above, a trace amount of metal components was detected in the pyrolysis oil of Example 1, falling under the embodiment.

Test Example 4: Analysis of the Pyrolysis Oil Components

The pyrolysis oil of Example 1 obtained through Test Example 1 was analyzed for the boiling point of each component contained in the pyrolysis oil by conducting a high-temperature simulation distillation test (SIMDIS) according to the ASTM D2887-19 standard. The results are shown in Table 3 below.

TABLE 3

| | Temperature (° C.) |
|---|---|
| Initial boiling point (IBP) | 58.0 |
| 5% by weight discharge temperature | 68.5 |

TABLE 3-continued

| | Temperature (° C.) |
|---|---|
| 10% by weight discharge temperature | 76.5 |
| 20% by weight discharge temperature | 96.5 |
| 30% by weight discharge temperature | 118.5 |
| 40% by weight discharge temperature | 149.5 |
| 50% by weight discharge temperature | 193.0 |
| 60% by weight discharge temperature | 231.0 |
| 70% by weight discharge temperature | 278.0 |
| 80% by weight discharge temperature | 332.0 |
| 90% by weight discharge temperature | 394.0 |
| 95% by weight discharge temperature | 434.0 |
| Final boiling point (FBP) | 515.5 |

Referring to Table 3 above, the pyrolysis oil of Example 1, falling under the embodiment, contained various substances. As a result, a specific boiling point for each substance was confirmed.

Test Example 5: Evaluation of the Physical Properties of the Polishing Pad

The polishing pads prepared in Examples 1 and 2 (before the polishing process) and Comparative Examples 1 to 3 were each evaluated for the following physical properties. The results are shown in Table 4 below.

(1) Hardness

A polishing pad sample having a size of 2 cm×2 cm in length and width was allowed to stand for 16 hours under the conditions of a temperature of 25° C. and a humidity of 50±5%. Thereafter, the Shore D hardness of the polishing pad was measured using a D-type hardness meter.

(2) Elastic Modulus

A polishing pad sample having a size of 4 cm×1 cm in length and width was measured for elastic modulus. Specifically, the elastic modulus was measured as the slope between the elongation at 70% and the elongation at 20% while the sample was tested at a speed of 50 mm/minute using a universal testing machine (UTM).

(3) Polishing Rate

Each polishing pad was fixed to the platen of CMP equipment, and a silicon wafer (diameter: 300 mm) was set with the tungsten (W) film thereof facing downward. Then, a CMP process was carried out. Specifically, the tungsten (W) layer was polished under a polishing load of 2.8 psi while the platen was rotated at a speed of 115 rpm for 30 seconds and a calcined silica slurry was supplied onto the polishing pad at a rate of 190 ml/minute. Upon completion of the polishing, the silicon wafer was detached from the carrier, mounted in a spin dryer, washed with deionized water, and then dried for 15 seconds. The difference in film thickness of the dried silicon wafer before and after the polishing was measured using a contact-type sheet resistance measuring instrument (with a 4-point probe). The polishing rate was calculated using the following Equation 1.

$$\text{Polishing rate (Å/min)} = \text{polished thickness of a silicon wafer (tungsten film) (Å)/polishing time (minute)} \quad \text{[Equation 1]}$$

(4) Within-Wafer Non-Uniformity

Polishing was performed for 1 minute under the same polishing conditions as the measurement of polishing rate. The in-plane film thickness of the silicon wafer was measured at 98 locations. The within-wafer non-uniformity (WIWNU) was calculated according to the following Equation 2.

$$\text{Within-wafer non-uniformity } (WIWNU)(\%) = \left(\text{standard deviation of polished thickness (Å)/average polished thickness (Å)}\right) \times 100(\%) \quad \text{[Equation 2]}$$

TABLE 4

| | Hardness (Shore D) | Elastic modulus ($N/mm^2$) | Polishing rate (Å/min) | Within-wafer non-uniformity (%) |
|---|---|---|---|---|
| Example 1 | 58 | 135 | 4,037 | 5.9 |
| Example 2 | 57 | 148 | 4,253 | 5.4 |
| Comp. Example 1 | 50 | 80 | 3,672 | 4.3 |
| Comp. Example 2 | 45 | 30 | 3,241 | 4.8 |
| Comp. Example 3 | 52 | 94 | 3,722 | 3.9 |

Referring to Table 4 above, the polishing pads of Examples 1 and 2, falling under the embodiment, were higher in hardness and elastic modulus than those of the polishing pads of Comparative Examples 1 to 3. They were also excellent in polishing rate and within-wafer non-uniformity.

The invention claimed is:

1. A polishing pad, which comprises a polishing layer, wherein, when pyrolysis oil obtained by pyrolyzing the polishing pad at 320° C. for 6 hours is analyzed according to the KS M 2457 standard, the content of chlorine components is 13,000 mg/kg to 16,000 mg/kg.

2. The polishing pad of claim 1, wherein, when the pyrolysis oil is analyzed by inductively coupled plasma atomic emission spectrometry, the content of metal components is less than 4 mg/kg (=ppm).

3. The polishing pad of claim 1, wherein, when the boiling point of the pyrolysis oil is analyzed according to ASTM D2887, the initial boiling point of the pyrolysis oil is 53 to 62° C., and the final boiling point of the pyrolysis oil is 510 to 520° C.

4. The polishing pad of claim 1, wherein the polishing pad further comprises an adhesive layer and a cushion layer.

5. The polishing pad of claim 1, wherein the polishing layer is formed from a composition that comprises a urethane-based prepolymer, a curing agent, and a foaming agent.

6. The polishing pad of claim 5, wherein the curing agent comprises 4,4'-methylenebis(2-chloroaniline).

7. The polishing pad of claim 5, wherein the urethane-based prepolymer has a content of isocyanate end groups (NCO %) of 7.5 to 11% by weight, and the reaction ratio of the urethane-based prepolymer and the curing agent is 1:0.75 to 1.1 as an equivalence ratio.

8. Pyrolysis oil, which is obtained from a polishing pad, wherein, when the pyrolysis oil is analyzed according to the KS M 2457 standard, the content of chlorine components is 13,000 mg/kg to 16,000 mg/kg.

9. The pyrolysis oil of claim 8, wherein the polishing pad is a spent polishing pad that has been used.

10. A process for preparing pyrolysis oil, which comprises:

charging a polishing pad into a chamber;

pyrolyzing the polishing pad charged into the chamber at 280 to 350° C.; and passing the vaporized stream formed by the pyrolysis through a heat exchanger to obtain liquid pyrolysis oil, wherein, when the pyrolysis oil is analyzed according to the KS M 2457 standard, the content of chlorine components is 13,000 mg/kg to 16,000 mg/kg.

11. The process for preparing pyrolysis oil of claim 10, wherein the polishing pad is a spent polishing pad that has been used.

* * * * *